US005996197A

United States Patent [19]

Jurkovic

[11] Patent Number: 5,996,197

[45] Date of Patent: Dec. 7, 1999

[54] ENVIRONMENT-COMPATIBLE COFFIN

[76] Inventor: Zeljko Jurkovic, Republike Austrije 3, Zagreb, Croatia

[21] Appl. No.: 09/151,969

[22] Filed: Sep. 11, 1998

[30] Foreign Application Priority Data

Sep. 18, 1997 [EP] European Pat. Off. ..... 97116295

[51] Int. Cl.[6] ..... A61G 17/00

[52] U.S. Cl. ..... 27/2; 27/27; 27/35

[58] Field of Search ..... 27/2, 3, 4, 5, 6, 27/7, 14, 16, 17, 27, 35; 16/110 R, 111 R, 114 R; 294/15

[56] References Cited

U.S. PATENT DOCUMENTS

| | | | |
|---|---|---|---|
| 1,306,457 | 6/1919 | Almiroty | 27/17 X |
| 1,349,799 | 8/1920 | Albrecht . | |
| 2,811,768 | 11/1957 | Axelson . | |
| 5,519,923 | 5/1996 | Rojdev et al. | 27/27 X |
| 5,522,116 | 6/1996 | Enneking et al. | 27/27 X |
| 5,531,000 | 7/1996 | Biondo | 16/114 R |
| 5,604,965 | 2/1997 | Shaw et al. | 27/2 |
| 5,680,682 | 10/1997 | Watkins et al. | 27/14 X |

FOREIGN PATENT DOCUMENTS

| | | |
|---|---|---|
| 1616160 | 3/1971 | Germany . |
| 2003429 | 8/1971 | Germany . |
| 2042019 | 3/1972 | Germany . |
| 4330151 | 3/1995 | Germany . |
| 420484 | 3/1967 | Switzerland . |

*Primary Examiner*—Terry Lee Melius
*Assistant Examiner*—William L. Miller
*Attorney, Agent, or Firm*—Bierman, Muserlian and Lucas

[57] ABSTRACT

For simplifying the production of a coffin or casket and to minimize the consumption of material as far as possible, different wall thicknesses are used for the walls of the coffin, namely the material thickness of the bottom is greater than that of the side walls and additional elements such as feet, grips, fasteners, fastener profiles, hinges, embellishments and the same are made integral with the coffin upper part/or the lower part or the detachable securing of such elements are made integral with the coffin upper part or the coffin lower part.

16 Claims, 10 Drawing Sheets

ENVIRONMENT-COMPATIBLE COFFIN

Figure 1:
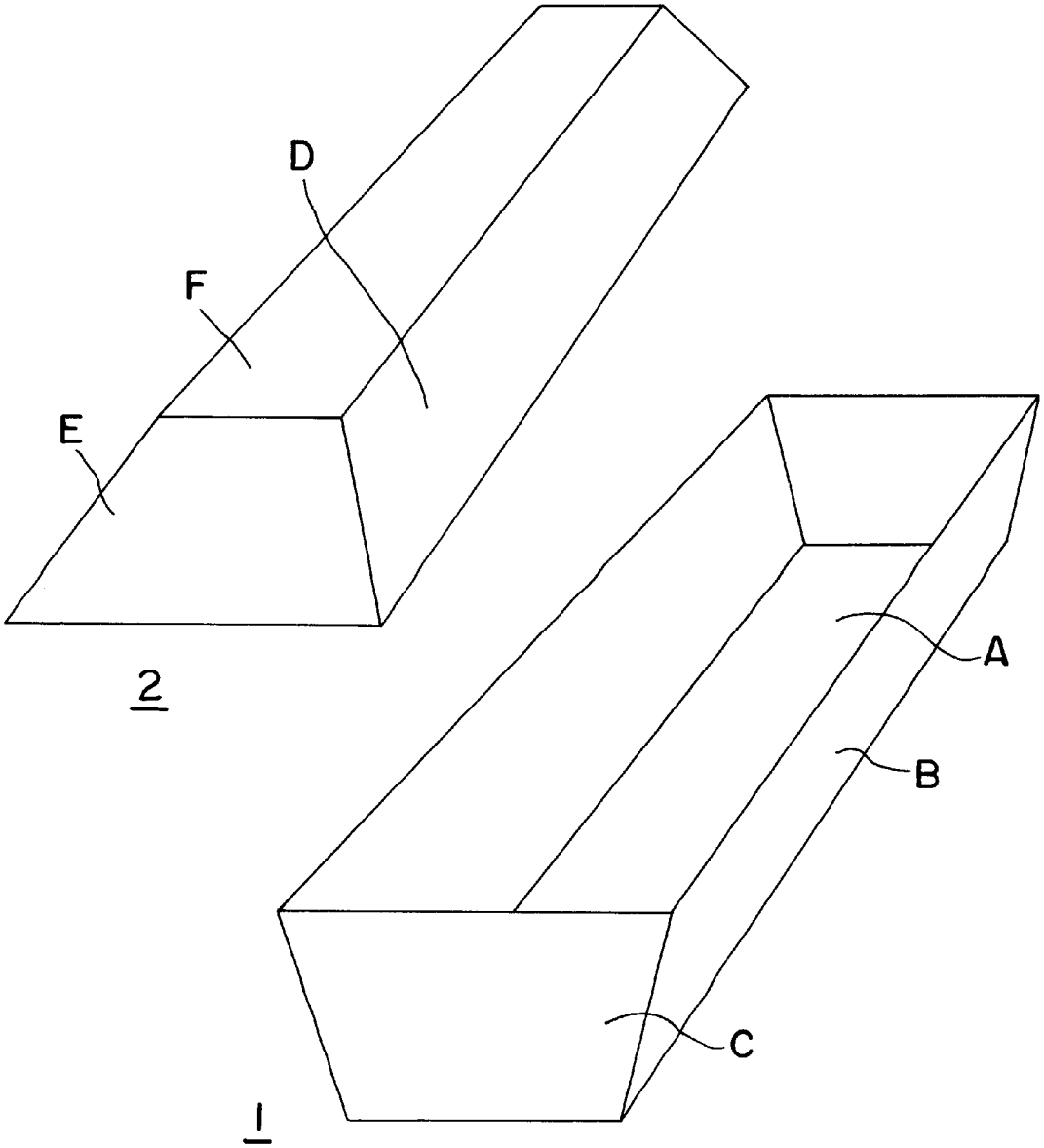

A coffin comprising an integral coffin lower member and an integral coffin upper member of decayable material with the coffin lower part having a bottom portion and a plurality of side walls.

Both from the ecological and from the economical point of view the coffins of solid wood mostly employed today are open to criticism. Thus, the making of a wooden coffin requires high expenditure of material, energy and labour. The material cannot be used again and rots relatively slowly; moreover, wooden coffins are relatively heavy.

According to DE-4335526 A1 it is suggested that coffins be made from resources-saving basic materials, such as waste paper; however, no features as to how this proposal can be put into practice can be derived from this publication. DE-2644487 C3 describes the production of a coffin or casket using paperboard or cardboard which is applied to a wire grating. From the points of view mentioned above this does not appear to the inventor to be a practicable approach because although the cardboard material rots relatively rapidly the wire mesh does not. Moreover, due to the wire grating this coffin is not suitable for cremations.

EP-0736296 A2 describes a coffin comprising an integral coffin lower member and an integral coffin upper member of decayable material with the coffin lower part having a bottom and a plurality of side walls. In this coffin the coffin upper part and the coffin lower part are integrally moulded from compression moulding composition of natural fibres impregnated with a binder, the feet and grip recesses being formed at the same time with the single compressing operation. To ensure the necessary strength these parts must therefore be made relatively massive. Furthermore, in the coffin bottom reinforcing ribs, etc., are provided and this makes the performing of the moulding for pressing the coffin upper part and coffin lower part difficult. With this structure variations in the design of the coffin are not possible.

The invention is accordingly based on the problem of simplifying the production of a coffin or casket according to the preamble and to minimise the consumption of material as far as possible. Furthermore, with a uniform basic structure the possibility of varying the design of the coffin is to be provided.

This problem is solved by the coffin of the invention comprising an integral coffin lower member and an integral coffin upper member of decayable material with the coffin lower member having a bottom and a plurality of side walls wherein the material thickness of the bottom is greater than that of the side walls.

In the coffin according to the invention the coffin upper part and the coffin lower part each consist of the same material, such as a flowable compression moulding composition or the like. For example, the coffin parts may also be made by firstly mixing a mixture of comminuted decayable material such as waste paper, waste cardboard, wood, horn, etc., with a binder and/or water, forming this mixture by injection moulding or hot pressing in the form of the coffin parts and then drying these coffin parts. Dyes or colouring materials, (for example foodstuff colouring materials or other colouring materials which do not impair the environment) may be added to the mixture or applied subsequently to the coffin parts. To minimise the material requirement for such a coffin it is proposed according to the invention to make the material thicknesses different in dependence upon the necessary loadbearing capacity. Thus, in particular it is suggested that the bottom of the coffin lower part be made thicker than the side walls.

Correspondingly, the lid region of the coffin upper part is made thinner than the side walls of the coffin upper part and the side walls of the coffin upper part are preferably made thinner than the side walls of the coffin lower part. This optimum configuration of the material thicknesses achieves firstly adequate stability of the coffin and secondly eliminates the necessity of forming reinforcements, ribs or the like; the material expenditure is also kept to a minimum.

It should be pointed out here that the particulars regarding the material thicknesses relate substantially to the thinnest large-area regions of the corresponding walls; in some locations deviations from said relationships may be present, for example in the region of embellishments, grip recesses, hinges, etc.

Additional elements such as feet, grips, fasteners, fastener or lock profiles, hinges, embellishments, or the like and/or means for detachable securing of such elements are preferably formed integrally with the corresponding coffin part. The detachable additional elements can then be removed from the coffin and used again.

Furthermore, it is possible to use the coffin according to the invention together with a separate bearing plate so that the coffin itself may be made relatively thin-walled, thereby resulting in a further saving of material.

Embodiments of the invention will be explained with the aid of the attached drawings, wherein:

A BRIEF DESCRIPTION OF THE DRAWINGS

Figure 2:
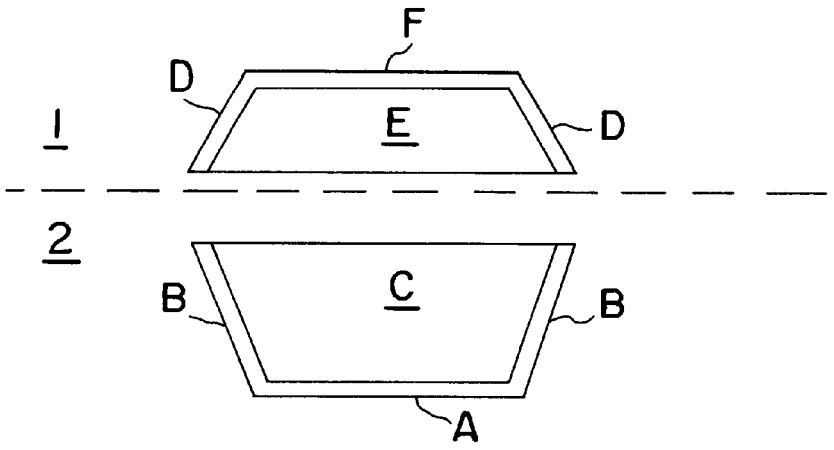
Figure 3:
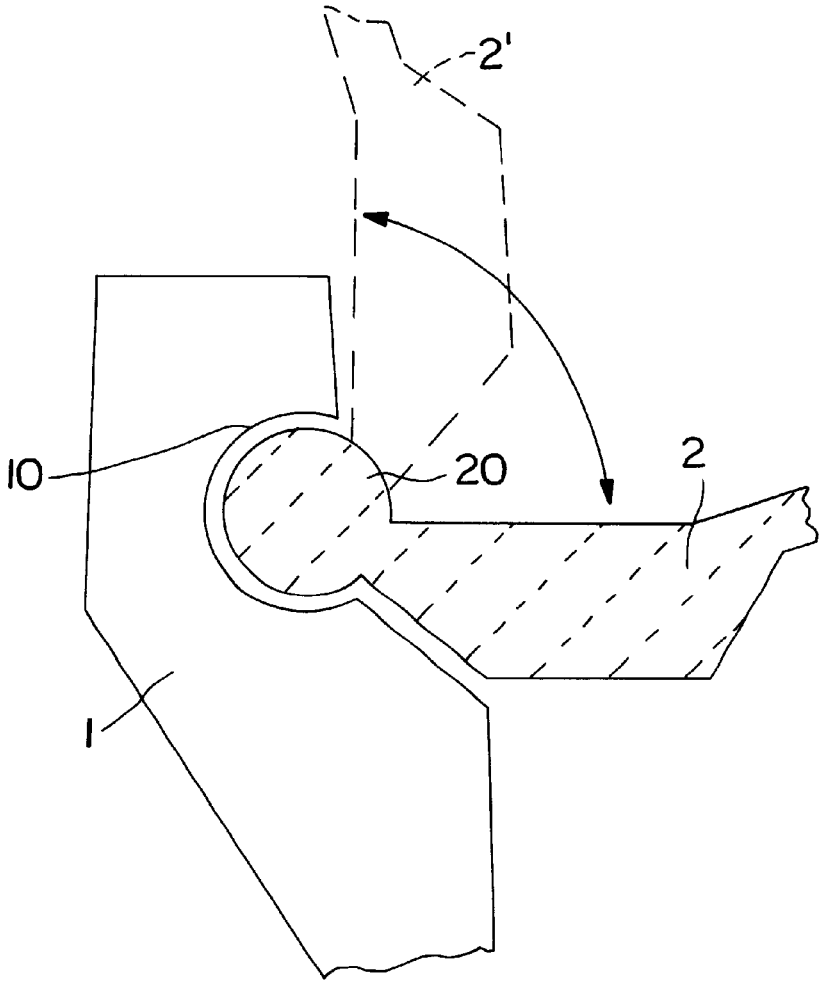
Figure 4A:
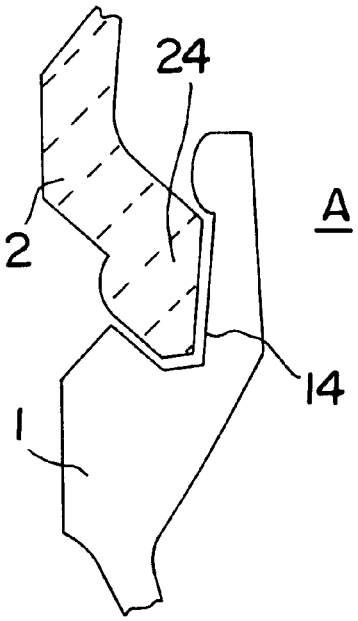
Figure 4B:
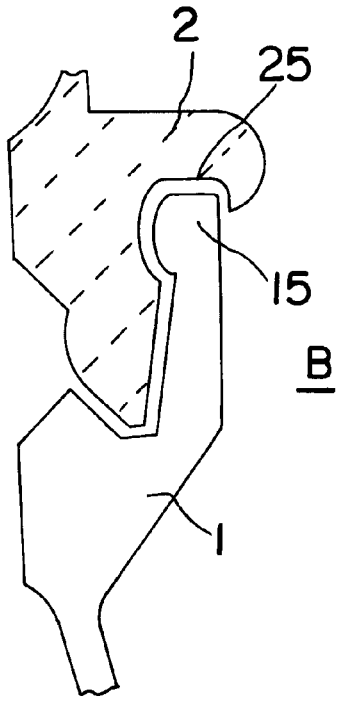
Figure 4C:
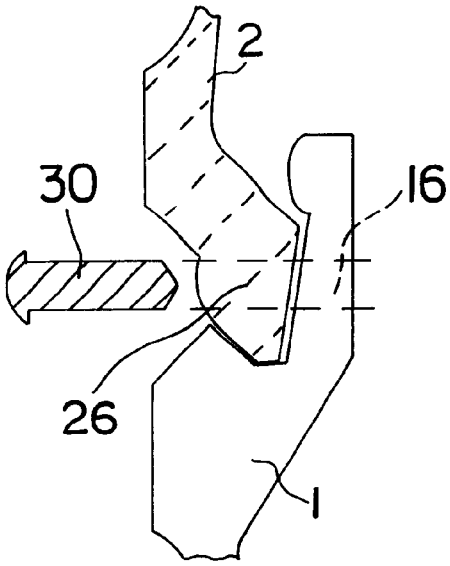
Figure 5:
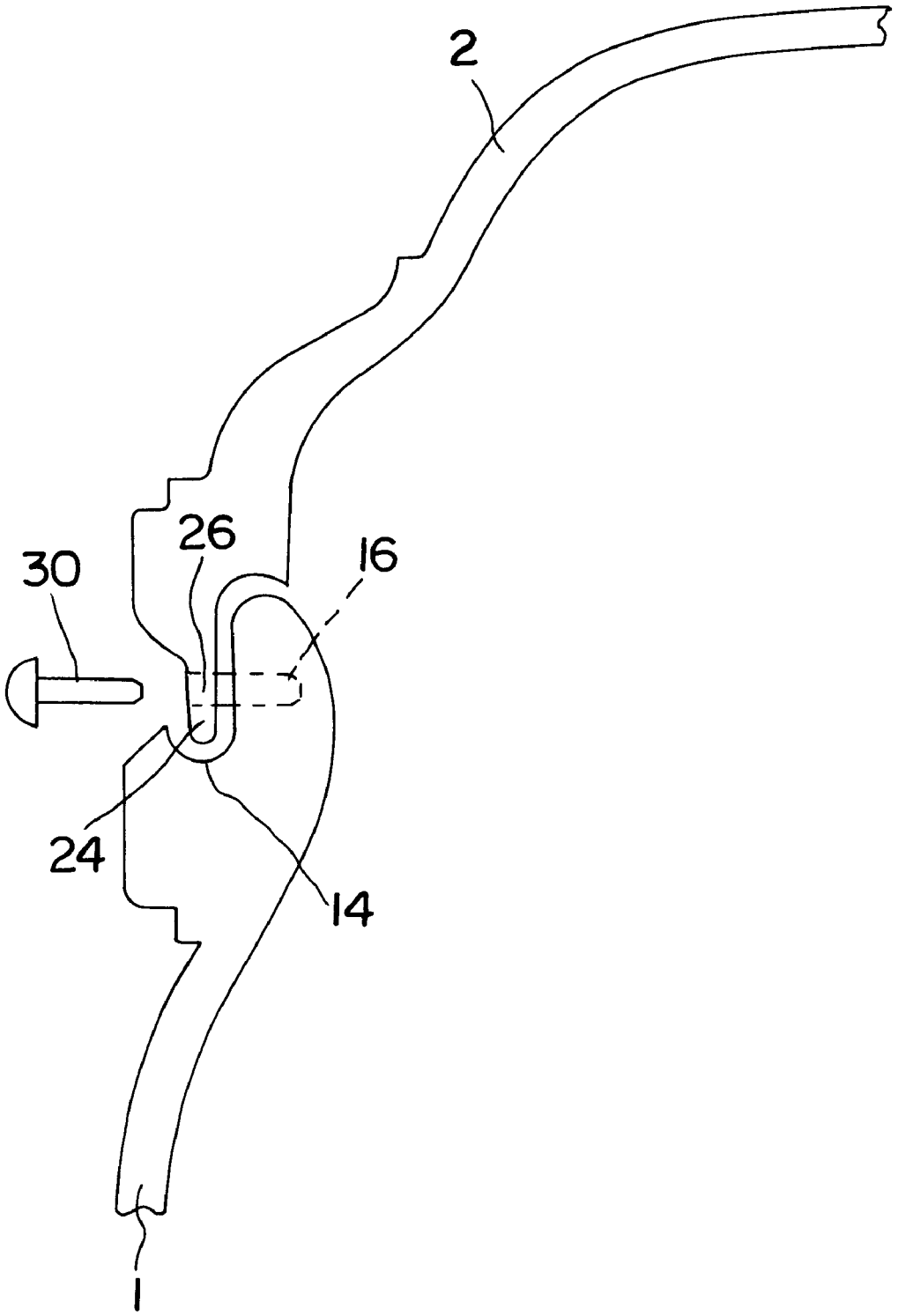
Figure 6A:
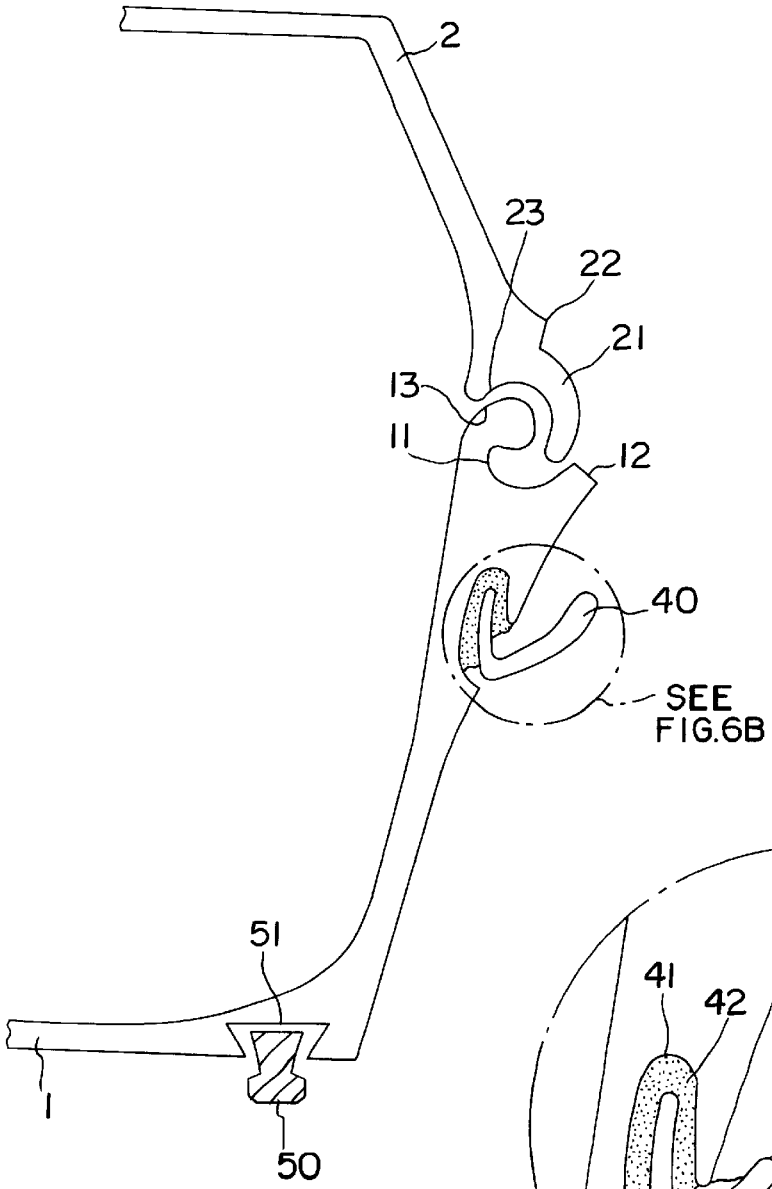
Figure 6B:
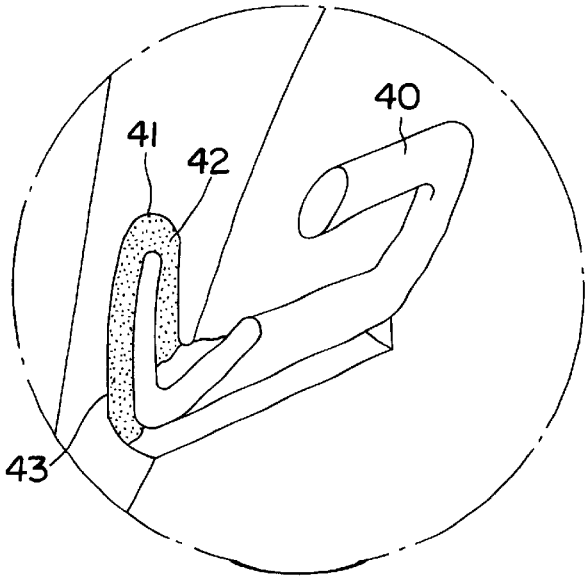
Figure 7A:
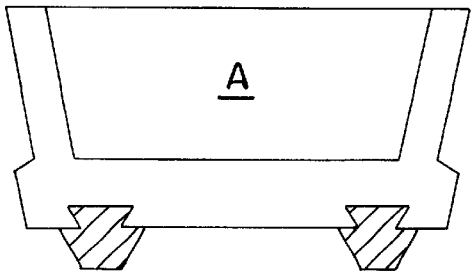
Figure 7B:
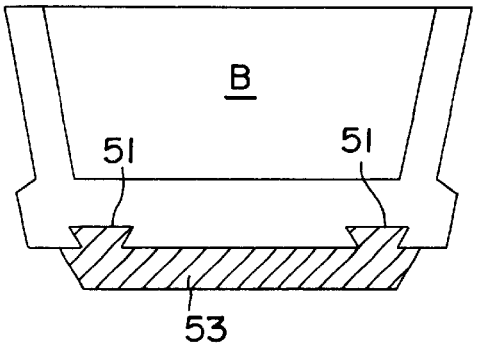
Figure 8:
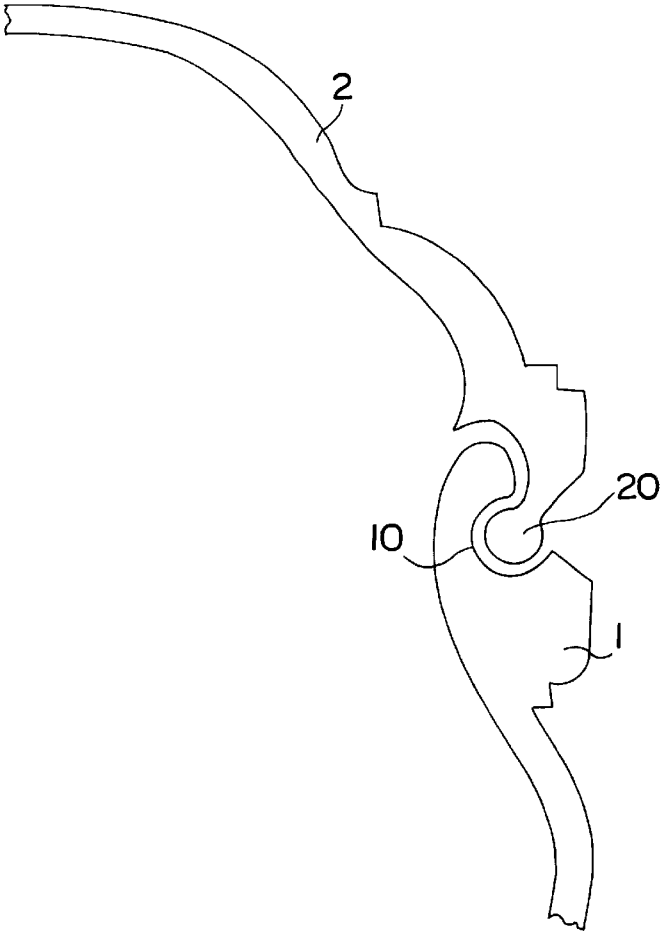
Figure 9:
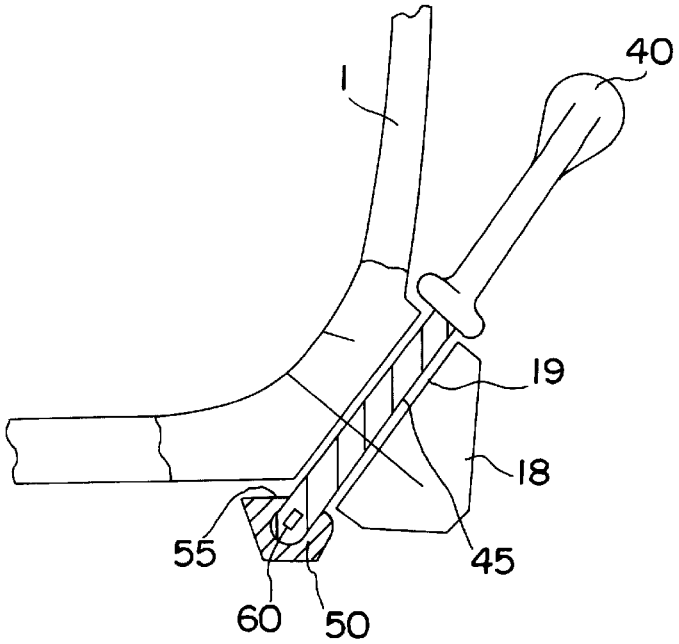
Figure 10A:
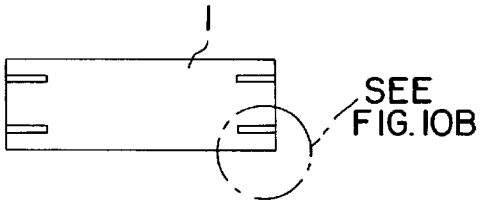
Figure 10B:
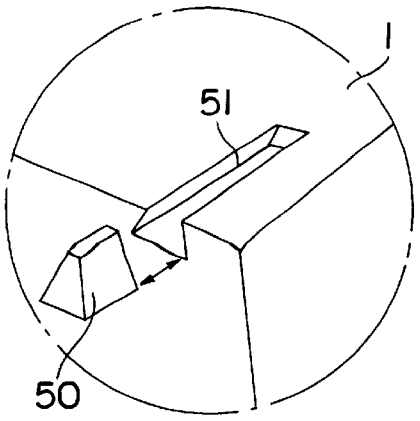
Figure 11:
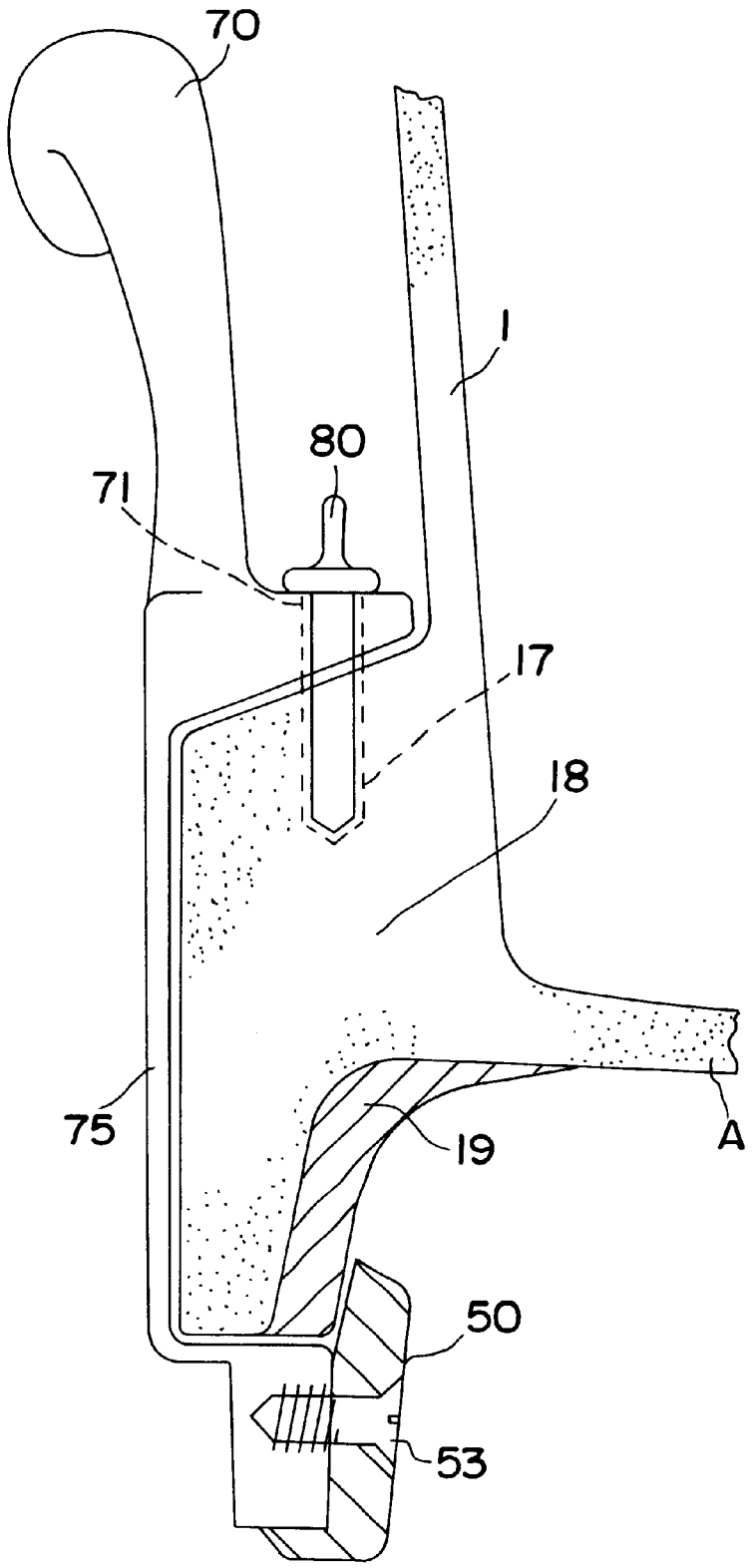
Figure 12:
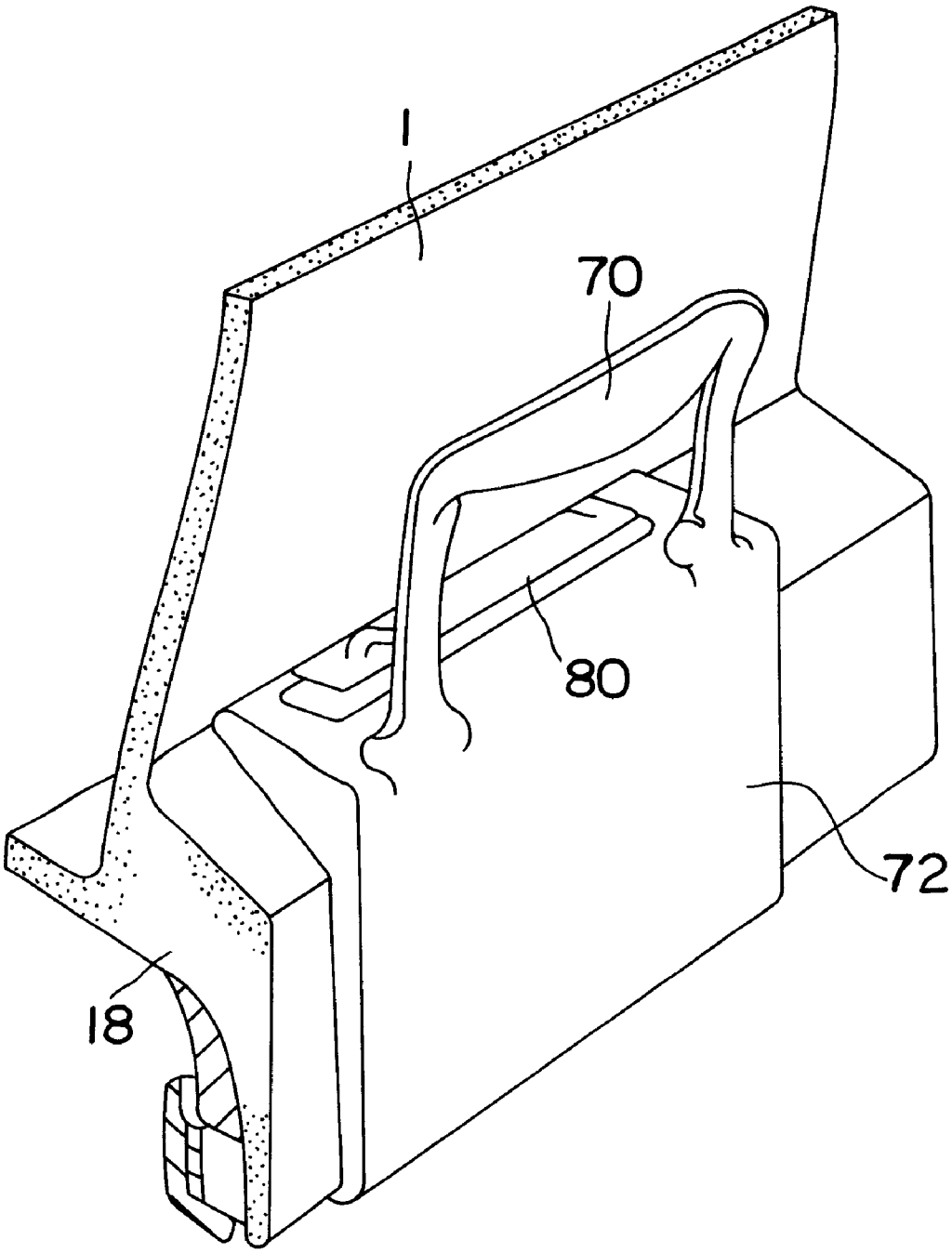
Figure 13:
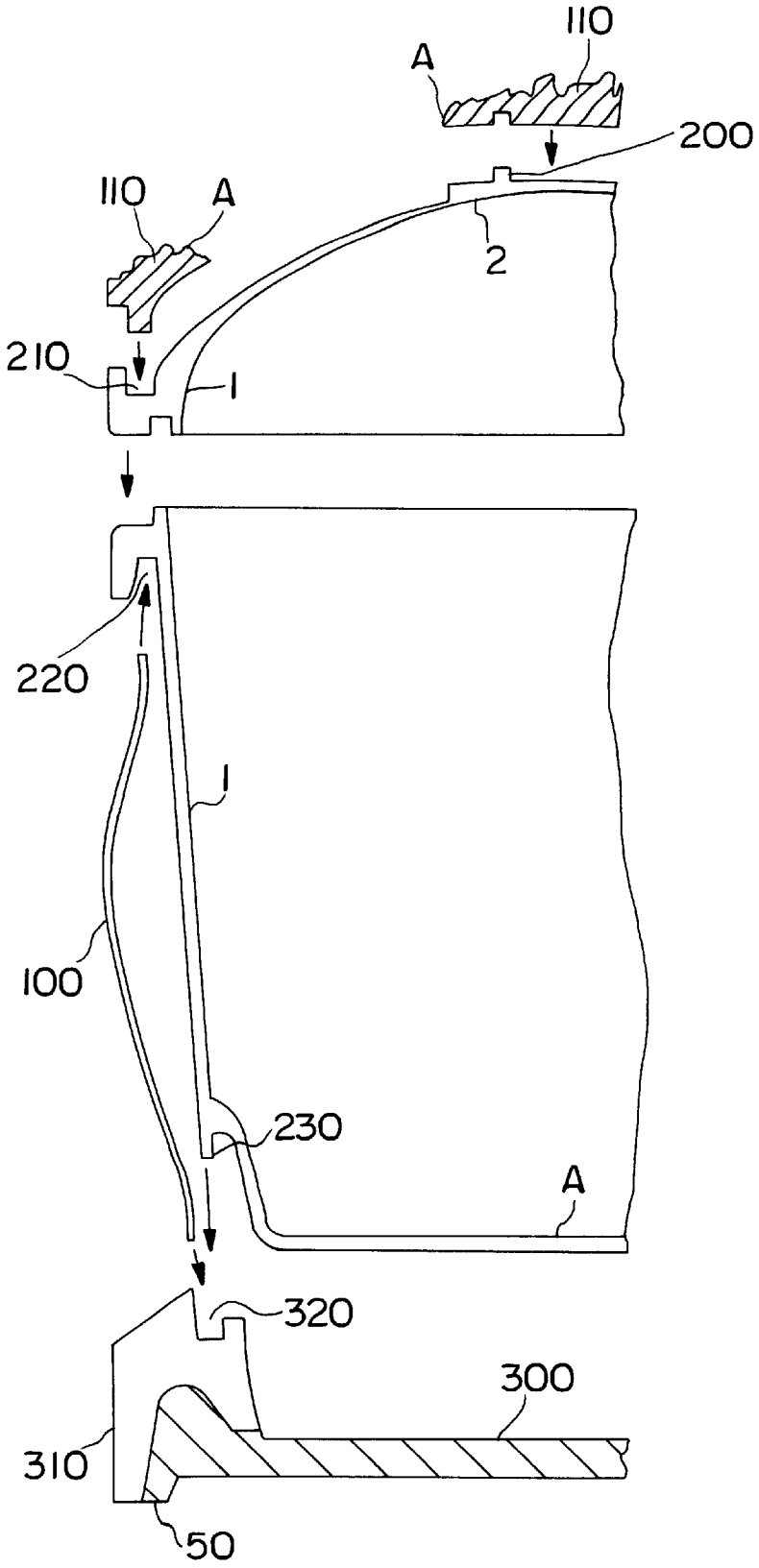

FIG. 1 is a schematic illustration of the coffin lower part and the coffin upper part, FIG. 2 is a schematic sectional illustration, FIG. 3 is a sectional illustration of a hinge, FIGS. 4*a* to 4*c* are sectional illustrations of fastener or closure profiles, FIG. 5 is a sectional illustration of a further closure profile, FIGS. 6A and 6B are sectional illustrations of a coffin according to the invention and an enlarged detail, FIG. 7 shows schematic sectional illustrations of a coffin lower part, FIG. 8 is a detail of a cross-section through a hinge region, FIG. 9 shows in section a detail of a foot and grip region, FIG. 10 is a detail view of a foot region, FIG. 11 is a sectional illustration to explain a detail of a grip-foot arrangement, FIG. 12 is a perspective view of the arrangement according to FIG. 11, FIG. 13 is a partial section of a further coffin according to the invention.

FIG. 1 shows schematically the structure of the coffin according to the invention consisting of a coffin lower part 1 and a coffin upper part 2. The coffin lower part 1 and the coffin upper part 2 are preferably made from decayable material, for example waste materials such as waste paper, waste cardboard, sawdust, wood chips or the like, in each case being made in one piece. For this purpose the material is first comminuted, mixed with a binder and thereafter compression moulded, injection moulded or the like.

According to the invention the material thicknesses differ in various regions of the coffin upper and lower portions. If, expressed in relative units, the coffin bottom A has a material thickness of 10, the side walls B of the coffin lower part preferably have a material thickness of 8 to 9, and the side walls C have a thickness of 6 to 8. The side walls D of the coffin upper part 2 have thicknesses of 5 to 7, the end walls of the upper part of about 4 to 6, the lid region of the coffin upper part 2 is usually the thinnest region and has a thickness of 3 to 5.

The units referred to above are meant as relative units related to the thickness of the coffin bottom A. In practice, for example with a relatively strong material, the thickness of the coffin bottom may be about 10 mm so that the relative units given above may then be taken directly as mm measurements. With a thicker coffin bottom, for example 15 mm, a corresponding factor (in that case 1.5) must be employed.

The particulars on the material thicknesses refer here to large-area portions of constant thickness which make up the greater part of the corresponding wall; locally, deviations can occur.

Frequently, coffin lids are not simply placed on the coffin lower part but articulately connected to the latter. For this purpose, metal hinges are usually employed; these are not suitable either for burial or for cremation because they do not rot away and also cannot be burnt. Admittedly, metal hinges may be screwed off before a cremation but this involves additional work.

In contrast, the invention proposes that the hinge members be formed directly and integrally on the coffin lower part 1 and the coffin upper part 2. Examples of embodiment of such integrally formed hinges or hinge portions are illustrated schematically in FIGS. 3, 6A and 8.

Thus, FIG. 3 shows in cross-section the upper edge of the coffin lower part 1 into which a groove 10 of substantially circular (segment) cross-section is formed. The lid-shaped coffin upper part 2 carries at its longitudinal edge a substantially circular projection 20 which engages into the groove 10.

The recess 10 and the projection 20 (which may also be formed as profile strip) are adapted to each other in their dimensions so that after the making of the coffin upper part 2 and the coffin lower part 1 the coffin upper part 2 is inserted longitudinally with the projection 20 into the groove 10 so that the coffin upper and lower parts are pivotally connected together. In the closed position the coffin upper part 2 comes to bear with its lower side region on the coffin lower part 1 and in the open position the coffin upper part 2' comes into engagement with a further stop surface in the coffin lower part 1.

The example of embodiment of FIG. 8 corresponds fundamentally to that of FIG. 3, although the groove 10 is open towards the coffin exterior and not towards the coffin interior as illustrated in FIG. 3.

FIG. 6A shows a further embodiment of a hinged connection. In this case a strip 21 of substantially arcuate cross-section is integrally formed in the coffin upper part 2 and can engage in a complementary groove 11 formed in the coffin lower part. In the closed position of the coffin illustrated the projection 21 does not engage into the groove 11 and a stop face 23 of the coffin upper part 2 is in engagement with a corresponding counter stop face 13 in the coffin lower part 1. In the open state the hinge strip 21 is introduced into the groove 11 until a stop face 22 on the coffin upper part 2 abuts against a corresponding counter stop face 12 in the coffin lower part 1.

All the hinge connections according to the invention may be formed as individual hinges which each extend only along a short region longitudinally of the coffin. Preferably, however, the hinges extend over the entire coffin longitudinal axis so that the projections 20, 21 are formed as profile battens or strips and the corresponding grooves or recesses 10, 11 likewise extend over the entire upper edge of the corresponding coffin part. Although in the embodiments in each case the projection is provided on the coffin upper part 2 and the groove on the coffin lower part 1, these arrangements may also be reversed.

Due to the fact that the hinge connections described above are each provided with separate stop faces, in the closed state an odour-tight sealing of the coffin is always ensured.

FIGS. 4A to 4C show various embodiments for the configuration of the upper edge of the coffin lower part and the lower edge of the coffin upper part 2. The coffin upper part 2 carries a projection 24 which engages in a complementarily formed groove 14 of the coffin lower part 1. This engagement of a projection in a groove, preferably over the entire coffin length, first increases the stability and secondly guarantees an almost hermetic sealing of the interior of the coffin. These effects are even further pronounced in the example of embodiment according to FIG. 4B in which in addition the coffin lower part 1 carries a further projection 15 which engages in an additional recess 25 in the coffin upper part 2.

To lock the coffin upper part 2 on the coffin lower part 1 closure elements 30 are provided, for example bolts, which consist of decayable material and are introduced into an opening 26 in the coffin upper part and an opening 16 aligning therewith in the coffin lower part. The coffin according to the invention may be provided exclusively with the fasteners according to FIGS. 4A and 4C or one of the fastener arrangements according to FIGS. 4A to 4C may be combined with one of the hinge arrangements described above in such a manner that on one longitudinal side a hinge arrangement is provided and on the other longitudinal side of the coffin a fastener or closure means according to FIGS. 4A to 4C.

A further embodiment having a projection 14 and a groove 24 is illustrated in FIG. 5, the fastener elements 30 being formed as elongated plate.

FIG. 6A shows schematically a cross-sectional view of a coffin according to the invention, detachable grips 40 and detachable feet 50 being provided.

As apparent in particular from FIG. 6B, for the detachable securing of the grip 40 a recess 41 is formed in the coffin lower part 1 and extends substantially in the vertical direction in the coffin lower part, being downwardly open. The recess 41 is lined with a lining material 42 and a hook-like projection or a projection strip 43 of the grip 40 is adapted to be introduced into the opening of the groove 41. The material 42 serves firstly to firmly hold the projection 43 in the groove 41 and prevent dropping out and secondly the material 42 provides damping against shocks which can occur when the coffin is carried. Preferably the material 42 is a felt but it may also be plastic, rubber or the like. Instead of lining the recess 41 with the material 42 it is furthermore possible to cover the projection 43 with the material 42. In this case, when the grip 40 is removed the material 42 is automatically removed from the groove 41 and can be used again.

Detachable feet may for example be implemented in that in the coffin lower part 1 dovetail grooves 51 are provided into which correspondingly formed feet 50 are inserted. This is illustrated in FIG. 6A and in particular in FIG. 10. These grooves may be arranged in the longitudinal or transverse direction of the coffin. A corresponding implementation is shown in FIG. 7, where two separate feet can be provided at each side of the coffin lower part 1. The example of embodiment according to FIG. 7B provides a particularly stable structure. In this embodiment not two separated feet 50 are not provided at each coffin end, the individual feet being instead connected together via a web 53. This arrangement of the web 53 appreciably increases the stability of the coffin.

The feet 50 and the web 53 may be made of wood or of any other desired material, such as steel, brass, etc.

A particularly advantageous combination of grips and feet is shown in FIG. 5. According to FIG. 5 the coffin lower part 1 comprises at its lower edge a projection 18 having a recess 19, the recess extending from the region of the coffin bottom to the region of the lower edge of the side wall.

A support rod 45 of the grip 40 is adapted to be introduced into said recess 19 and with its end remote from the grip 40 engages into a corresponding recess 55 in the foot 50. In this position the support rod 45 is locked by a securing element 60, for example a bolt, splint or the like, which extends transversely of the displacement direction of the support rod 45. The support rod can be formed as single rod or two support rods 45 may be provided per grip 40 and extend into corresponding bores. Instead of providing a support rod 45 it is also possible to provide a support plate extending in a corresponding slit-shape recess in the coffin bottom part 1.

A variant of the embodiment according to FIG. 9 is illustrated in FIGS. 11 and 12. In this embodiment the coffin lower edge again bears a projection 18 around which the holding structure of a grip 70 engages. For this purpose a stirrup member 75 is formed on the grip 70 and bears a further projection 73. A foot 50 is secured by securing means 53, for example a screw, to the projection. As a whole the stirrup member forms with the projection 73, the foot 50 and the grip 70 a substantially G-shaped undercut opening which engages in form-locking manner round the horn-like projection 18. As apparent in particular from FIG. 12, on the upper part of the stirrup member 75 a securing plate 80 is provided which engages through an opening 71 into a complementary formed opening 17 in the projection 18. By inserting the securing plate 80 the grip can be locked on the coffin lower part 1 and can easily be removed along with the foot by releasing the securing plate 80.

The two embodiments of FIG. 9 and FIGS. 11 and 12 have the substantial advantages that by one operation both the grip and the associated foot can be removed from the coffin.

FIG. 13 shows a further embodiment of a coffin preferably used together with a carrier or support plate 300. The support plate may be made from a stronger material, for example wood, but production from rottable moulding material is likewise possible. The coffin lower part 1 is placed on the surface of the support plate 300, the support plate further comprising bearing elements 310 which serve to position and secure the coffin. In the upper part of the bearing element 210 a groove 320 is formed into which a correspondingly formed tenon or strip 230 of the coffin lower part 1 engages as indicated by the arrows. Furthermore, on the support plate 300 feet 50 are formed. Grips (not illustrated) are likewise mounted on the support plate 300.

Also, at the upper edge of the coffin lower part a projection is provided and comprises a downwardly open groove 220 for receiving flat embellishment covers 100. On setting down the coffin the lower edge of the embellishment cover 100 is introduced together with the projection 230 of the coffin bottom part 1 into the groove 320 and at the same time the upper edge of the embellishment cover 100 is introduced into the groove 220 at the upper edge of the coffin lower part 1.

In the coffin upper part grooves 210 and/or tenons, studs or strips 200 are provided who serve to secure embellishment elements 110, the embellishment elements 110 having correspondingly complementarily formed tenons, strips or grooves.

With this embodiment of the coffin according to the invention it is possible with only one basic body to implement various designs of coffins because the embellishment covers 100 and elements 110 can be individually selected. Furthermore, these additional elements can be simply removed from the basic body of the coffin prior to the actual burial or cremation. The support plate is formed as separate element and can therefore be used again because for example with cremations only the coffin comprising the coffin lower part 1 and the coffin upper part 2 is burnt.

The embodiments illustrated here can all be combined with each other; with the configuration according to the invention of the fasteners, embellishments, hinges, feet or grips, etc., it is not absolutely essential to use different material thicknesses for the walls, although this step is preferred.

I claim:

1. A coffin comprising an integral coffin lower member (1) and an integral coffin upper member (2) of decayable material, at least the coffin lower member (1) having a bottom (A), longitudinal side walls (B), and end walls (C) wherein the material thickness of the bottom (A) is greater than that of the side walls and end walls (B,C); elements including feet (50), grips (40), fasteners, fastener profiles (24,14), hinges (10,20), embellishments (110,100) and means for detachable securing the elements are made integral with at least one of the coffin upper member (2) and the coffin lower member (1); the coffin has an extending projection comprising an opening which extends from a bottom region of the coffin to a side region thereof and one of the grips (40) has an elongated support element (45) adapted to be introduced through a recess in the projection (18) and into a recess (55) of one of the feet (50) and arrested therein.

2. Coffin according to claim 1, wherein the coffin upper member (2), comprises a lid region (F) longitudinal side regions (D), and end regions (E), the material thickness of the lid region (F) being less than that of the side and end regions (E, D).

3. Coffin according to claim 2 wherein the material thickness of the longitudinal side walls of the coffin lower member is greater than the material thickness of the longitudinal side region (D) of the coffin upper member and that the material thickness of the end walls (C) of the coffin lower member is greater than the material thickness of the end regions (E) of the coffin upper member.

4. Coffin according to any one of claim 2, wherein if the material thickness of the bottom (A) is defined as 10 in relative units, the material thicknesses of other walls are dimensioned as follows:

longitudinal side walls (B) of the coffin lower member 8–9, the end walls (C) of the coffin lower member 6–8, longitudinal side walls (D) of the coffin upper member 5–7, the end walls (E) of the coffin upper member 4–6, the lid region (F) of the coffin upper member 3–5.

5. Coffin according to claim 1 wherein the material thickness of the longitudinal side walls (B) is greater than that of the end walls (C).

6. Coffin according claim 1, wherein the coffin carries at one of the longitudinal side walls at least one of the hinges, the hinge comprising a projecting substantially arcuate projection (21) or a projection strip on the coffin upper member or on the coffin lower member which engages into a complementarily formed recess (11) on the coffin lower member or on the coffin upper member.

7. Coffin according to claim 1, wherein one of the hinges is positioned in one of the longitudinal side walls of the coffin, the hinge having a projecting projection (20) of substantially circular cross-section on the coffin upper member or on the coffin lower member which engages into a complementarily formed recess (10) in the coffin lower member or in the coffin upper member respectively.

8. Coffin according to of claim 1, wherein the coffin lower member comprises a longitudinal groove (14) and that the coffin upper member has a correspondingly formed projection strip (24) and that in the closed state the projection strip engages in form-locking manner into the longitudinal groove.

9. Coffin according to of claim 1, wherein at least in the coffin lower member side region a downwardly open recess (41) is provided into which a hook portion (43) of one of the grips (40) can be introduced, the recess being lined with at least one of a friction-inhibiting and damping material (42) or the hook portion (43) being covered with such a material.

10. Coffin according to any one of claim 1, wherein the coffin comprises at its lower edge the projection (18) and one of the grips (70) to which a stirrup member (75) and one of the feet (50) are attached in such a manner that the grip engages around the projection.

11. Coffin according to claim 1, wherein in an outer region of the coffin bottom includes dovetail grooves into which one of the complementarily formed feet (50) can be introduced which project beyond the dovetail groove.

12. Coffin according to claim 11, wherein the feet are connected together by a web (53) extending transversely of the coffin longitudinal direction.

13. A coffin comprising: an integral coffin lower member (1) and an integral coffin upper member (2) of decayable material, at least the coffin lower member (1) having a bottom (A) and a plurality of side walls (B, C); wherein a support plate (300) for receiving the coffin, the support plate having bearing elements (310) for supporting and positioning the coffin; a receiving element (220) is formed at an upper edge of the coffin lower member and at least one embellishment cover (100) is adapted to be introduced into the receiving element (220) and the bearing element (310) of the support plate.

14. Coffin according to claim 13, wherein the bearing elements (310) cooperate with complementarily formed counter pieces on the coffin lower member (1).

15. Coffin according to claim 13, wherein feet and grips are provided on the support plate.

16. Coffin according claim 13, wherein the coffin upper member (1) comprises grooves, tenons or profiles to which embellishment elements (110) can be attached.

* * * * *